US008023679B2

(12) United States Patent
Liu

(10) Patent No.: US 8,023,679 B2
(45) Date of Patent: Sep. 20, 2011

(54) WIRELESS EARPHONE WITH AN INDICATING LIGHT

(75) Inventor: Chien-Liang Liu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 1004 days.

(21) Appl. No.: 11/875,882

(22) Filed: Oct. 20, 2007

(65) Prior Publication Data

US 2009/0103759 A1 Apr. 23, 2009

(51) Int. Cl.
*H04R 17/02* (2006.01)

(52) U.S. Cl. ..... 381/365; 381/87; 381/92; 381/122; 381/355; 381/361; 381/395

(58) Field of Classification Search ..... 381/87, 381/92, 122, 355, 361, 365, 395
See application file for complete search history.

(56) References Cited

U.S. PATENT DOCUMENTS 7,292,823 B2 * 11/2007 Kuo ..... 455/41.2
2002/0064276 A1 * 5/2002 Winegar ..... 379/430
2006/0019718 A1 * 1/2006 Kuo ..... 455/569.1
2006/0245598 A1 * 11/2006 Batai ..... 381/74
2007/0147644 A1 * 6/2007 Bodley et al. ..... 381/334
2007/0230727 A1 * 10/2007 Sanguino et al. ..... 381/315
2008/0226112 A1 * 9/2008 Lin ..... 381/375
2008/0260198 A1 * 10/2008 Rath et al. ..... 381/381
2008/0310662 A1 * 12/2008 Davidson et al. ..... 381/355
2009/0073950 A1 * 3/2009 Guccione et al. ..... 370/341
2009/0103759 A1 * 4/2009 Liu ..... 381/361
2009/0202096 A1 * 8/2009 Ryann ..... 381/374
2009/0232328 A1 * 9/2009 Deline et al. ..... 381/86
2010/0278350 A1 * 11/2010 Rung ..... 381/59
2011/0075876 A1 * 3/2011 Bucheim et al. ..... 381/365

* cited by examiner

*Primary Examiner* — David S. Warren
(74) *Attorney, Agent, or Firm* — WPAT, P.C.; Anthony King

(57) ABSTRACT

A wireless earphone with an indicating light includes a cover, a hanger connected to the cover, a housing, a microphone, an indicating light and a PCB. An outer hole is opened in the cover. The housing is accepted in the cover. An inner hole is opened in the housing and corresponding to the outer hole. The microphone and the indicating light are arranged in the housing and connect to the PCB, the indicating light protrudes into the inner hole. An escutcheon is arranged between the outer hole and the inner hole to resist dust into the inner hole. The light from the indicating light is delivered via the inner hole and the outer hole to the outside.

3 Claims, 3 Drawing Sheets

WIRELESS EARPHONE WITH AN INDICATING LIGHT

BACKGROUND OF THE INVENTION

1. Field of the Invention

This present invention relates to a wireless earphone, and more specifically to a wireless earphone with an indicating light on a microphone side.

2. The Related Art

A wireless earphone is used with a mobile, a MP3 and other electric devices to receive or deliver audio signal. In order to indicate the state of the wireless earphone, an LED as an indicating device is arranged in the wireless earphone to indicate the state of the wireless earphone, such as lack power, charging, calling, and etc.

Conventionally, the LED is arranged in the middle of the outside surface of the wireless earphone and connects to a PCB, a hole is opened in the outside surface of the wireless earphone to accept the LED, while the LED indicating the state of the wireless earphone, the light from the LED is emitted to the outside.

At present, the wireless earphone is becoming smaller and smaller, so the LED is needed to be arranged inside of the wireless earphone instead of being arranged outside of the wireless earphone to save the space and more easily manufactured.

SUMMARY OF THE INVENTION

An object of the invention is to provide a wireless earphone with an indicating light includes a cover, a housing, a PCB, a microphone and an indicating light. The cover has an outer hole. The housing is accepted in the cover, an inner hole is opened in the housing and corresponds to the outer hole of the cover. A microphone hole is opened in the housing and communicates with the inner hole, and an illuminant-accepting hole is opened in the housing and communicates with the inner hole. The PCB is accepted in the cover. The microphone is arranged in the microphone hole of the housing and connects to the PCB. The indicating light is arranged in the illuminant-accepting hole of the housing and protrudes into the inner hole, the indicating light connects to the PCB.

As the above description, the indicating light is arranged in the light hole of the housing communicating with the inner hole instead of being arranged outside the wireless earphone with an indicating light, the volume of the wireless earphone with an indicating light will be reduced, and the manufacture cost will be saved.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
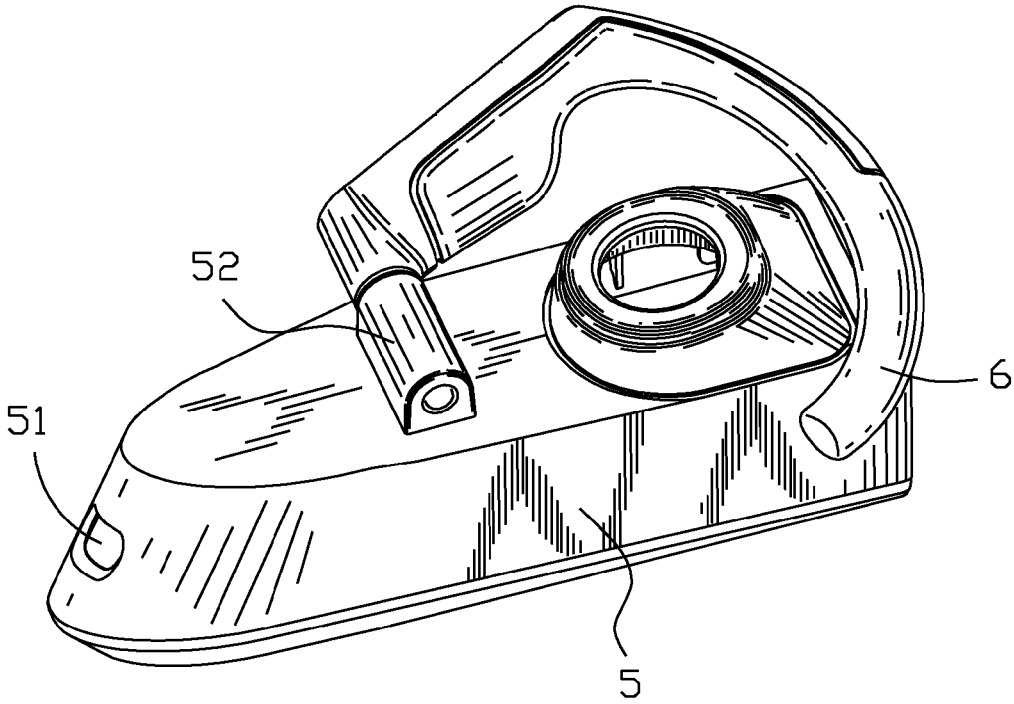
FIG. 1 is a perspective view of a wireless earphone with an indicating light according to the present invention.
Figure 2:
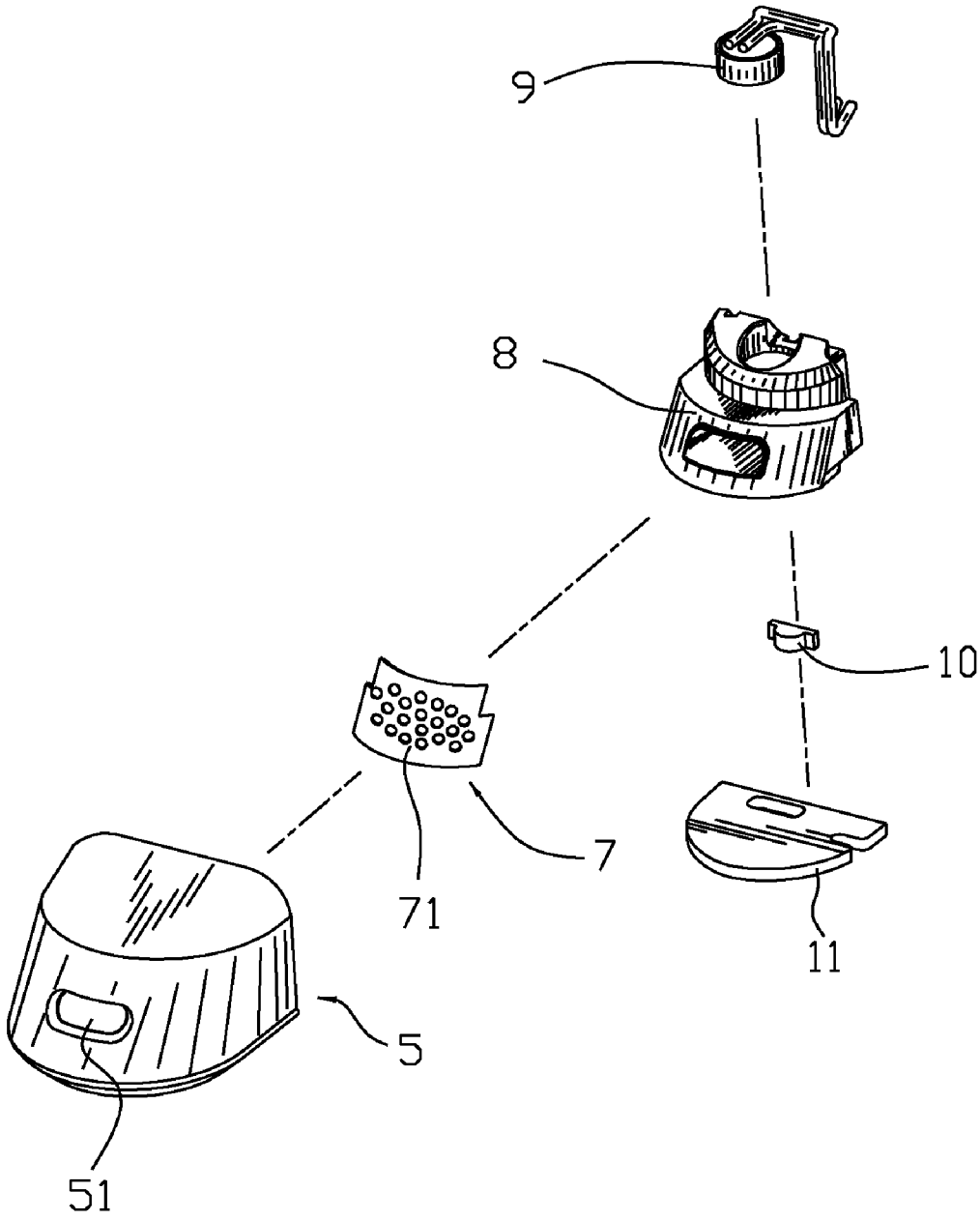
FIG. 2 is an exploded perspective view of the wireless earphone with an indicating light which is cut for showing a front portion of the wireless earphone with an indicating light.

First referring to FIGS. 1 and 2, a wireless earphone with an indicating light according to the invention is shown. The wireless earphone with an indicating light comprises a cover 5, a hanger 6 connected to the cover 5, an escutcheon 7, a housing 8, a microphone 9, an indicating light 10 and a PCB 11.

An outer hole 51 is opened in the front end of the cover 5. A connecting base 52 is arranged in the middle of the top of the cover 5, one end of the hanger 6 is accepted in the connecting base 52. An indicating light 10 connects the PCB 11, the indicating light 10 and the PCB 11 are accepted in the cover 5. The microphone 9 connects to the PCB 11 and is accepted in the cover 5. The housing 8 is accepted in the cover 5 and is made of elastoplastic.

Figure 3:
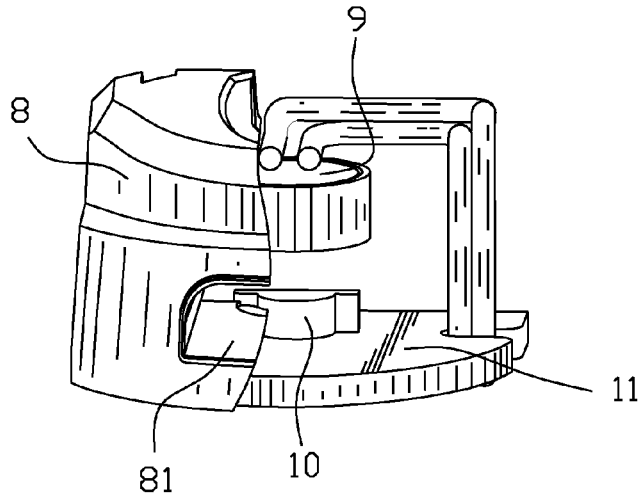
FIG. 3 is a partly perspective view showing a housing, an microphone, an indicating light and a PCB of the wireless earphone with an indicating light shown in FIG. 2.
Figure 4:
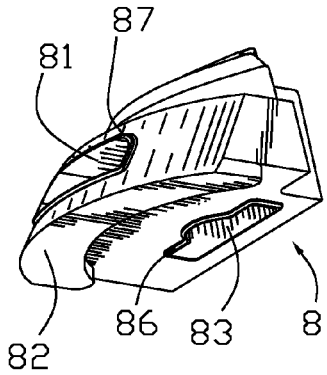
FIG. 4 is another perspective view showing the housing shown in FIG. 2.
Figure 5:
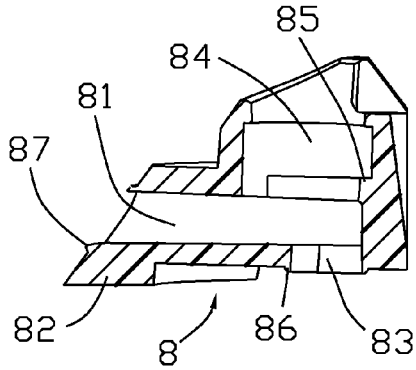
FIG. 5 is a cross-sectional view of the housing shown in FIG. 4.

Please refer to FIGS. 3, 4 and 5, an inner hole 81 is opened in a front surface of the housing 8 and extends towards the inside of the housing 8, the inner hole 81 is corresponding to the outer hole 51 of the cover 5. An illuminant-accepting hole 83 is opened in the bottom of the housing 8 and extends upward to communicate with the inner hole 81. A microphone hole 84 is opened at the upside of the inner hole 81 and communicates with the inner hole 81. The microphone 9 is accepted in the microphone hole 84, the indicating light 10 is accepted in the illuminant-accepting hole 83 and protrudes into the inner hole 81. In this embodiment, the indicating light 10 is an LED. The indicating light 10 is used to indicate the state of the wireless earphone. The front surface of the housing 8 protrudes forward a little to form a front edge 87 around the front of the inner hole 81. A microphone supporter 85 is arranged in the microphone hole 84 to support the microphone 9. A supporting platform 85 is formed in the front of the bottom of the housing 8. The supporting platform 85 shows a semicircle shape. A protruding rim 86 is arranged in the bottom of the housing 8 around the end of the illuminant-accepting hole 83 to fasten the housing 8 on the PCB 11. When the PCB 11 is assembled with the housing 8, the front edge of the PCB 11 resists the supporting platform 85. The microphone 9 and the indicating light 10 connect to the PCB 11 which is arranged under the housing 8, in this embodiment, the indicating light 10 is mounted on the PCB 11.

The escutcheon 7 is arranged between the outer hole 51 of the cover 5 and the inner hole 81 of the housing 8. A plurality of holes 71 are opened in the escutcheon 7 to resist dust into the inner hole 81. The front edge 87 cooperates with the escutcheon 7 to assure the escutcheon 7 is firmly combined with the housing 8.

The voice from the outside is delivered to the microphone 9 via the outer hole 51, the escutcheon 7 and the inner hole 81, then the microphone 9 transforms the voice into an electrical signal. The light from the indicating light 10 is delivered via the illuminant-accepting hole 83, the inner hole 81, the escutcheon 7 and the outer hole 51 to the outside.

As the above description, the indicating light 10 is arranged in the illuminant-accepting hole 83 of the housing 8 communicating with the inner hole 81 instead of being arranged outside the wireless earphone with an indicating light, the volume of the wireless earphone with an indicating light will be reduced, and the manufacture cost will be saved.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A wireless earphone, comprising:

a cover having an outer hole;

a housing accepted in the cover and near the outer hole of the cover, defining an inner hole corresponding to the outer hole of the cover, a microphone hole communicating with the inner hole, and an illuminant-accepting hole communicating with the inner hole, a supporting platform formed in the front of the bottom of the housing, a protruding rim arranged in the bottom of the housing around the end of the illuminant-accepting hole;

a PCB accepted in the cover and arranged beneath the housing, the front edge of the PCB resisting the supporting platform;

a microphone arranged in the microphone hole of the housing and electrically connected to the PCB; and an indicating light arranged in the illuminant-accepting hole of the housing and protruding into the inner hole, the indicating light electronically connected to the PCB.

2. The wireless earphone as set forth in claim 1, further comprising an escutcheon arranged between the outer hole of the cover and the inner hole of the housing, a plurality of holes are opened in the escutcheon.

3. The wireless earphone as set forth in claim 1, wherein the illuminant-accepting hole is defined at one side of the inner hole and communicates with the outside, the microphone hole is defined at the other side of the inner hole, the indicating light disposed on the PCB.

* * * * *